US007950656B2

(12) United States Patent
Adams

(10) Patent No.: US 7,950,656 B2
(45) Date of Patent: May 31, 2011

(54) METHOD OF DETECTING OVERLAPPING SHEETS WITHIN A PAPER FEED MECHANISM, A DETECTOR FOR DETECTING OVERLAPPING SHEETS, A FEED MECHANISM INCLUDING SUCH A DETECTOR AND AN APPARATUS INCLUDING SUCH A DETECTOR

(75) Inventor: Guy Adams, Stroud Glos (GB)

(73) Assignee: Hewlett-Packard Development Company, L. P., Houston, TX (US)

( * ) Notice: Subject to any disclaimer, the term of this patent is extended or adjusted under 35 U.S.C. 154(b) by 1009 days.

(21) Appl. No.: 11/762,195

(22) Filed: Jun. 13, 2007

(65) Prior Publication Data

US 2007/0292191 A1 Dec. 20, 2007

(30) Foreign Application Priority Data

Jun. 13, 2006 (GB) ..... 0611616.4

(51) Int. Cl.
*B65H 7/12* (2006.01)
*B65H 7/02* (2006.01)

(52) U.S. Cl. ..... 271/262; 271/265.04

(58) Field of Classification Search ..... 271/262, 271/263, 265.04, 270, 272
See application file for complete search history.

(56) References Cited

U.S. PATENT DOCUMENTS

| | | | | |
|---|---|---|---|---|
| 6,364,556 | B1 | 4/2002 | Barbera et al. | |
| 6,761,352 | B2 * | 7/2004 | Scicluna et al. | 271/153 |
| 6,817,610 | B2 * | 11/2004 | Rompe | 271/265.04 |
| 6,913,260 | B2 * | 7/2005 | Maier et al. | 271/265.04 |
| 2001/0035603 | A1 * | 11/2001 | Graves et al. | 271/265.01 |
| 2001/0042956 | A1 | 11/2001 | Minoru et al. | |
| 2003/0141653 | A1 * | 7/2003 | Kumamoto et al. | 271/262 |

FOREIGN PATENT DOCUMENTS

| | | |
|---|---|---|
| EP | 0 404 287 | 1/1995 |
| EP | 0 894 756 | 2/1999 |

* cited by examiner

*Primary Examiner* — David H Bollinger

(57) ABSTRACT

A paper feed detector is disclosed for detecting when a plurality of overlapping sheets of paper occur in a transport path intended to transport paper to a first region. The paper feed detector includes a light source and an image forming arrangement adapted to form an image having a spatially varying intensity; and an image detector. An optical path from the light source to the image detector passes through the transport path. The image detector is adapted to assess degradation of the image to make an assessment of the number of sheets within the transport path.

12 Claims, 6 Drawing Sheets

METHOD OF DETECTING OVERLAPPING SHEETS WITHIN A PAPER FEED MECHANISM, A DETECTOR FOR DETECTING OVERLAPPING SHEETS, A FEED MECHANISM INCLUDING SUCH A DETECTOR AND AN APPARATUS INCLUDING SUCH A DETECTOR

CLAIM TO PRIORITY

This application claims priority from co-pending United Kingdom utility application entitled, "METHOD OF DETECTING OVERLAPPING SHEETS WITHIN A PAPER FEED MECHANISM, A DETECTOR FOR DETECTING OVERLAPPING SHEETS, A FEED MECHANISM INCLUDING SUCH A DETECTOR AND AN APPARATUS INCLUDING SUCH A DETECTOR" having serial no. GB 0611616.4, filed Jun. 13, 2006, which is entirely incorporated herein by reference.

FIELD OF THE INVENTION

The present invention relates generally to a paper feed detector for detecting a plurality of overlapping sheets within a paper transport path, to a method of detecting overlapping sheets, to a transport mechanism including such a detector, and to a device including such a transport mechanism.

SUMMARY OF THE INVENTION

According to a first aspect of the present invention there is provided a paper feed detector for detecting when a plurality of overlapping sheets of paper occur in a transport path intended to transport paper to a first region, the paper feed detector comprising:

a) a light source and image forming arrangement adapted to form an image having a spatially varying intensity; and b) an image detector;

wherein an optical path from the light source to the image detector passes through the transport path, and the image detector is adapted to assess degradation of the image to make an assessment of the number of sheets within the transport path.

It is thus possible to provide a paper feed detector for detecting misfeed of the paper within a paper transport path. The present invention is directed towards paper of the type primarily used within an office environment. As such this tends to be white paper having a weight range typically between 60 and 200 gm per $m^2$.

According to a second aspect of the present invention there is provided a paper feed mechanism including a paper detector according to a first aspect of the present invention.

According to a third aspect of the present invention there is provided a photocopier, facsimile machine or scanner including a paper feed mechanism and further including a paper feed detector according to the first aspect of the present invention.

According to a fourth aspect of the present invention there is provided a method of monitoring transport of sheets of paper within a paper transport path arranged to feed paper to a first region, the method comprising:

a) forming a test image having one or more distinguishable features therein; and b) detecting the test image with an image detector so as to identify the distinguishable features therein;

wherein, in use, paper within the paper transport path is introduced into an optical path conveying the test image to the image detector and the image detector is arranged to estimate a change in the distinguishable features and as a function of that change determine a number of sheets of paper in the optical path.

BRIEF DESCRIPTION OF THE DRAWINGS

The present invention will further be described, by way of example only, with reference to the accompanying drawings, in which.

DESCRIPTION OF PREFERRED EMBODIMENTS OF THE PRESENT INVENTION

Figure 1:
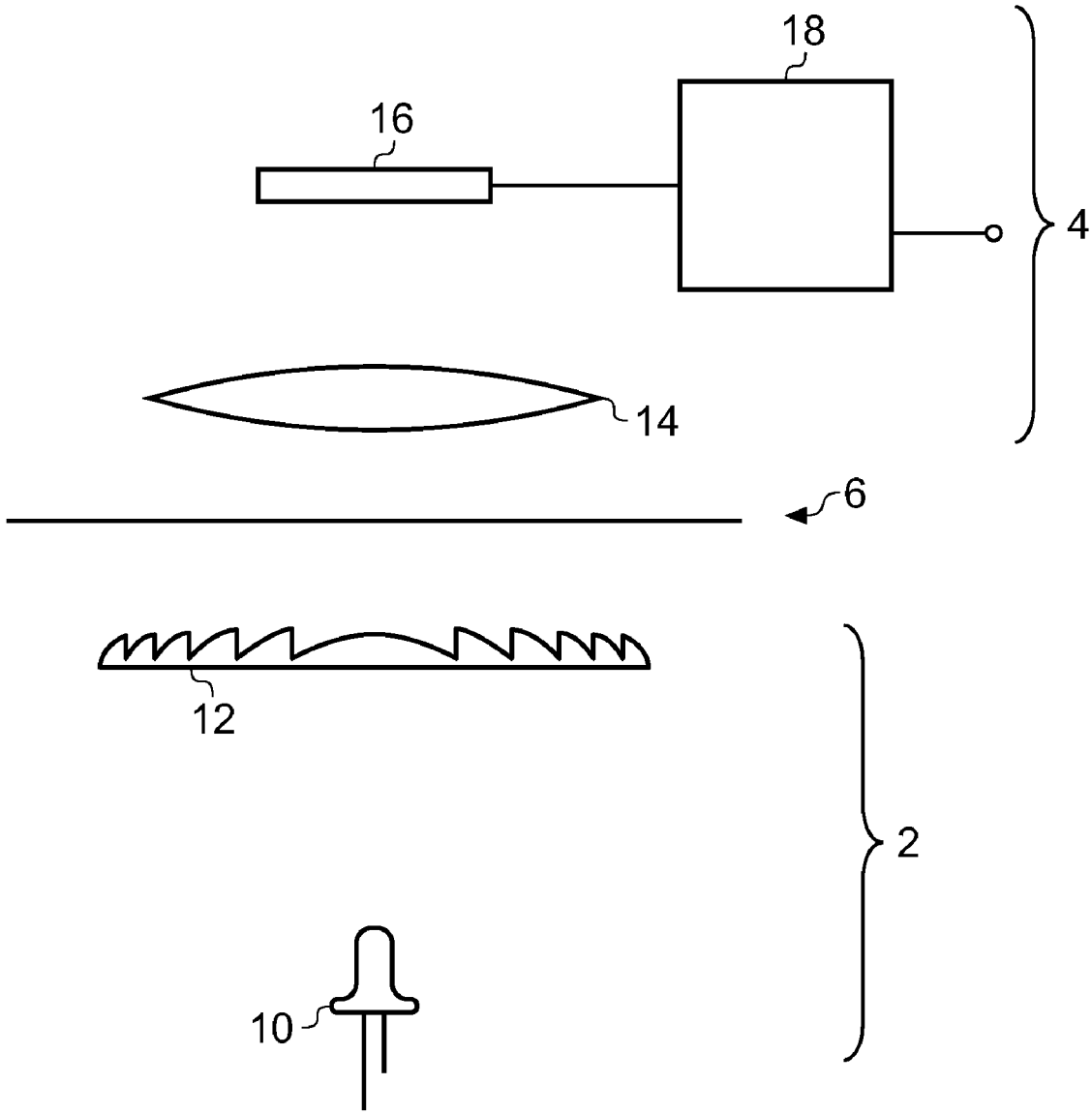
FIG. 1 schematically illustrates a paper feed detector constituting an embodiment of the present invention.

A paper feed detector constituting a first embodiment of the present invention is schematically illustrated in FIG. 1. The paper feed detector comprises a light source and image forming arrangement, generally designated 2 and an image detector, generally designated 4, positioned on opposing sides of a transport path for paper, the transport path being generally designated 6.

The light source is preferably a point light source, as this is easier to focus, such as a light emitting diode 10. Other light sources, such as incandescent bulbs or an optical feed from the scanning light source within, for example, a photocopier or scanner by way of an optical fibre can also be used. The light from the light source 10 is then spatially modulated so as to form an image having distinguishable features of varying intensity therein and then the light is directed towards the image detector 4 and hence across transport path of the paper. The spatial modulation and directional control of the light can conveniently be performed by a single component such as a fresnel lens 12. However, the use of other image forming apparatus, such as a lens (fresnel or otherwise) in combination with an image bearing film or the use of aligned apertures within two or more plates so as to form a plurality of collimated light beams is also possible. A laser could also act as a source.

Where lenses are used, the designer has the option either to focus the beam(s) to infinity, such that the light propagated towards the image detector is nominally parallel, or to focus the light onto an image plane substantially coincident with the paper in the paper transport mechanism.

In use, paper being conveyed along the paper transport path 6 by a paper transport mechanism (not shown) interrupts the light propagating between the light source and image forming arrangement 2 and the image detector 4. The paper does not block the light beam completely but instead can be regarded as acting as a secondary image source because some of the light propagating through the paper will undergo reflection and to a lesser degree refraction from the matrix of fibres and particles within the paper. The effect of one or more sheets of paper within the optical path will be considered in greater detail hereinafter with reference to FIGS. 2 and 3.

Light passing through the paper is collected by a lens 14 of the image detector and focused onto a detector array 16 which is arranged to provide its output to a data processor 18. The detector array 16 may be a one dimensional or two dimensional array of photo-detectors, although clearly the most inexpensive solution is a one dimensional array of photo-detectors. The data processor 18 is arranged to analyse the outputs of the array 16 in order to identify the distinguishable features in the image provided by the light source and image forming arrangement 2 and to look for degradation in the relative intensity or sharpness of the distinguishable features in order to make an assessment of the number of sheets of paper located between the light source and image forming arrangement 2 and the image detector 4.

In order to consider how the image detector makes an assessment of the number of sheets of paper in the optical path, it is worthwhile considering the effect of one or more sheets of paper on light passing along the optical path between the light source and image forming arrangement 2 and the image detector 4.

Figure 2:
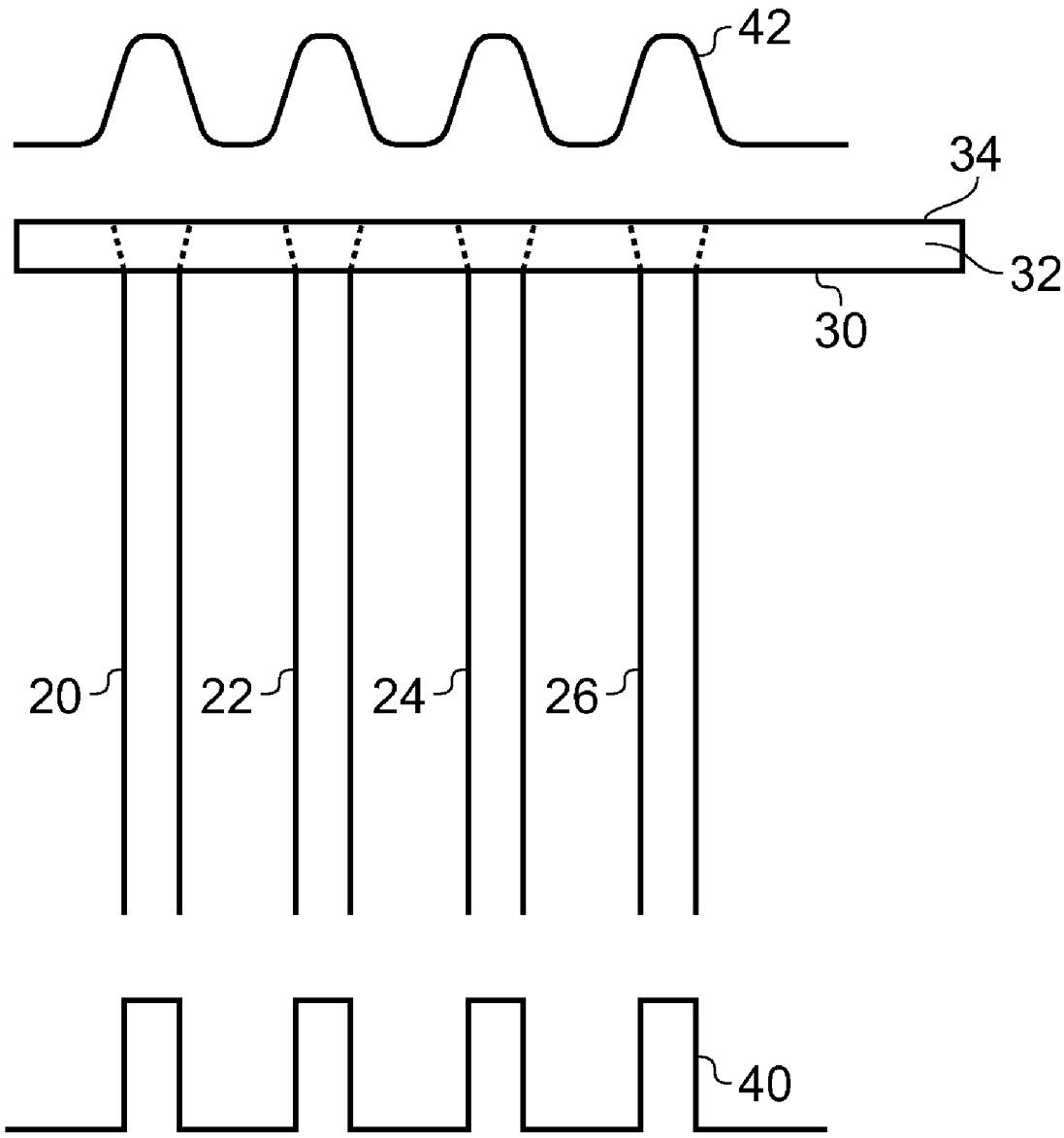
FIG. 2 schematically illustrates the intensity of an image occurring at a surface of a sheet of paper when illuminated by a plurality of collimated beams of light.

FIG. 2 schematically shows a bundle of light rays 22, 24, 26 and 28 which have a well constrained spatial extent and which are parallel to one another. These collimated bundles of rays 20, 22, 24 and 26 are incident on a first surface 30 of a sheet of paper 32. As the rays 20, 22, 24 and 26 propagate through the matrix of fibres forming the paper 32, multiple reflections occur (and limited refraction) which tends to cause divergence or spreading of the beams such that the beams are no longer collimated by the time they exit the paper 32 at a second surface 34. This second surface 34 can be regarded as acting as a secondary image source although many of the properties of the primary image source are maintained. Thus light emitted from the second surface of the paper can be regarded as the superposition of an attenuated version of the first image, and a second image formed by the process of complex reflection within the paper. The second image is not collimated as most of the rays leave the surface at random, non-perpendicular angles.

A plot of relative intensity of the light impinging on the paper as a function of position is schematically illustrated by the line 40 whereas the corresponding plot of relative intensity as a function of position of the light at the second surface of the paper 34 is designated by the line 42. It can be seen that the sharp transitions in the plot 40 become smoother in the plot 42 but that distinct light areas and dark areas still exist.

Figure 3:
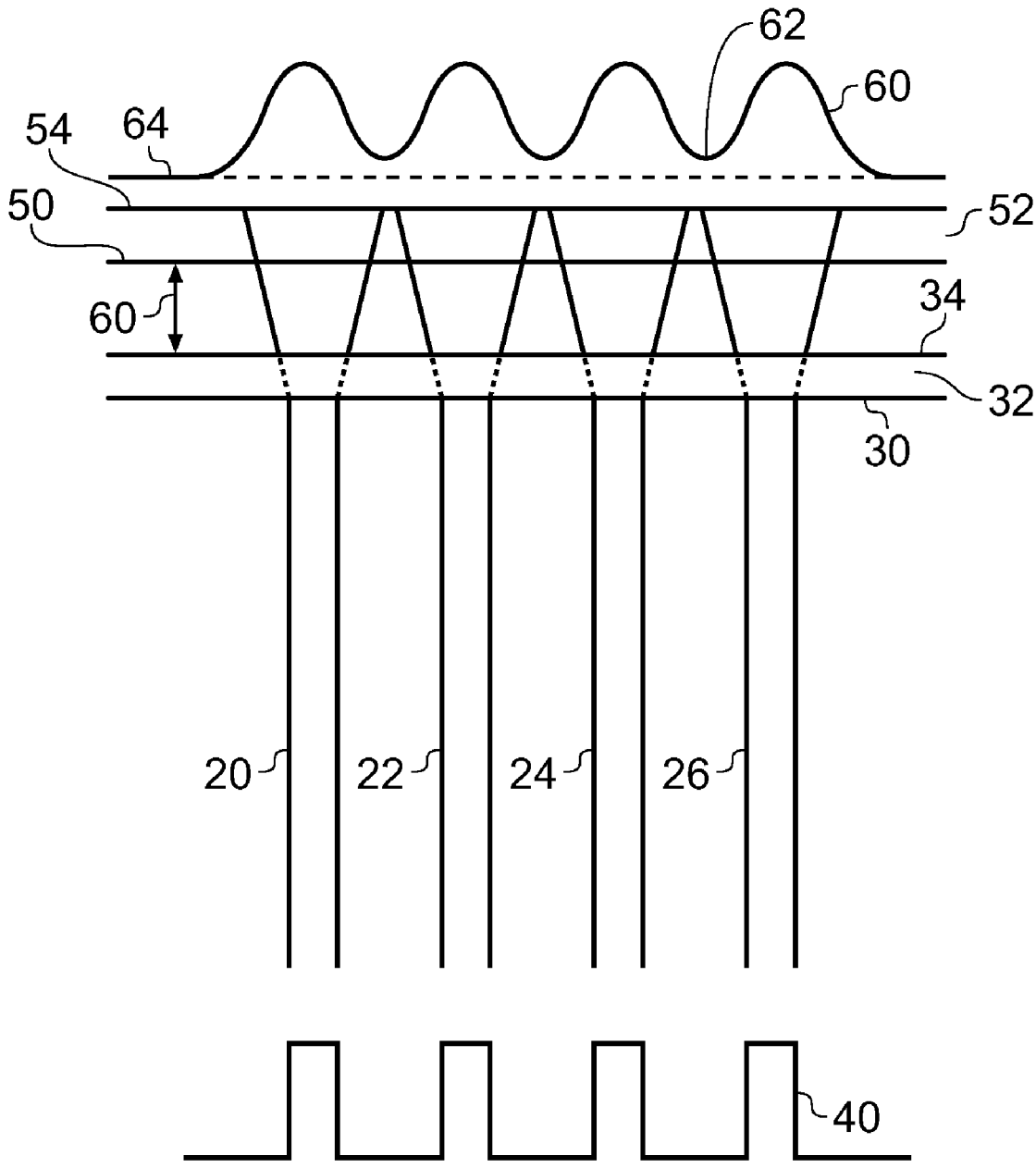
FIG. 3 schematically illustrates the intensity of an image occurring when two sheets of paper separated by an air gap are illuminated with the same illumination pattern as shown in FIG. 2.

Suppose now that the situation shown in FIG. 2 is reproduced but this time a second sheet of paper 52 is situated adjacent the sheet of paper 32 such that light exiting from the second surface 34 of the sheet of paper 32 now impinges upon a first surface 50 of the sheet of paper 52. Such a scenario is schematically illustrated in FIG. 3. Light passing through the second sheet of paper 52 also undergoes complex reflection prior to exiting from the second surface 54 of the sheet of paper 52.

It can also be seen that the existence of a gap 60 between the first sheet of paper 32 and the second sheet of paper 52 causes the spatial extent of the light beam incident on the first surface 50 of the second sheet of paper 52 to be significantly larger than the spatial extent of any of the corresponding light beams 20, 22, 24 or 26 impinging on the first face 30 of the first sheet of paper 32.

The second sheet of paper 52 can be thought of as acting as a tertiary image source and the image exiting from the second surface 54 thereof can be focused by the lens 14 of the image detector 4 towards the photo-detector array 16. A plot of relative intensity as a function of spatial position is schematically shown in FIG. 3 by the line 60. It can be observed that the transitions between the dark regions and the light regions are now much smoother and it can also be observed that the brighter portions of the image have now become sufficiently smeared or blurred that they start to merge into one another and hence the dark regions as schematically designated by a trough 62 still contain some light and are not as dark as the region 64 well away from the first beam 20. It can therefore be seen that the inclusion of a second sheet of paper and an air gap between the first sheet of paper and the second sheet of paper acts to blur the image arriving at the image detector compared to the image that would be received when a single sheet of paper exists in the paper transport path.

It can therefore be seen that an assessment of the number of sheets of paper in the optical path can be achieved by looking at defocusing of the image provided by the light source. Various techniques related to image processing could be used to assess defocusing of the image. However, given that the purpose of the invention is to provide a degree of confidence in the sheet feeding mechanism of an office item, such as a scanner or a photocopier, then a relatively simple and inexpensive image processing mechanism is appropriate. It can be seen from FIG. 3 that a transition between light and dark becomes blurred by the inclusion of a second sheet and hence that it is sufficient merely to be able to make an assessment of the speed of the transition between light and dark as a function of position. If a relatively high resolution sensor is used, then it becomes possible to assess the number of pixels that have an intermediate value.

Figures 4A, 4B, 4C, 4D, 4E:
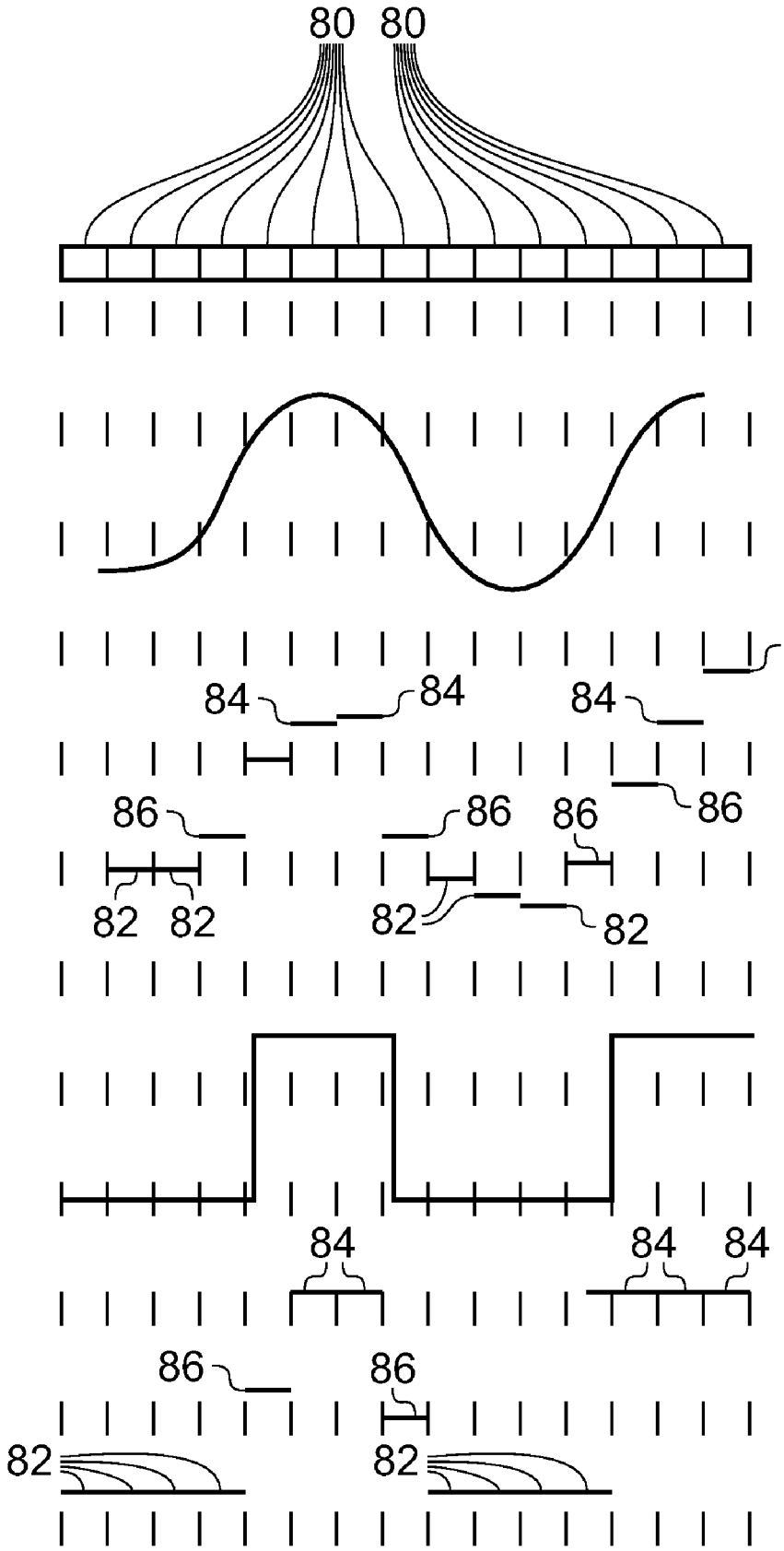
FIG. 4*a* shows the positions of individual detectors within a photodetector array.
FIG. 4*b* shows a first image due to a misfeed impinging on the photodetector array.
FIG. 4*c* shows the sample values in a digitised representation of the image shown in FIG. 4*b*.
FIG. 4*d* shows a second image impinging on the photodetector array and not due to a paper misfeed.
FIG. 4*e* shows the sample values for a digitised version of the image shown in FIG. 4*d;*

FIG. 4*a* schematically shows the positions of the individual photodetectors 80 of the photodetector array. FIG. 4*b* shows the relative intensity as a function of position of the light received by the photodetector array when two sheets of paper are in the optical path between the light source and the photodetector array. FIG. 4*c* schematically represents the digitised values output from each of the detectors. It can be seen that, by virtue of the finite spatial extent of each of the detectors 80, a quantised approximation to the smooth waveform of FIG. 4*b* is output. However it can also be seen that there is a significant spread of values within the digitised scheme. There are a significant number of values which are at or close to the minimum light intensity value, and which have been generally designated 82. There are also a significant number which are close to the maximum light intensity value and which have been designated 84. However there are also a significant number of intermediate values designated 86. If the same analysis is repeated for the image received at the photodetector when no paper is in the light path, we see that the vast majority of values are those either at the minimum value 82 or at the maximum value 84. With only a few values taking an intermediate value 86 where a transition between light and dark occurs within the area covered by a single given pixel. Therefore it is clear that an assessment of the spread of the values gives an indication to the likelihood that two sheets of paper are in the optical path. Such an assessment can be made by binning the output value from the array into bins for the purpose of constructing an histogram and then looking at the spread of values. Such an analysis does not require the plotting of a histogram as such and is within the knowledge of a person skilled in the art to implement.

Figure 5:
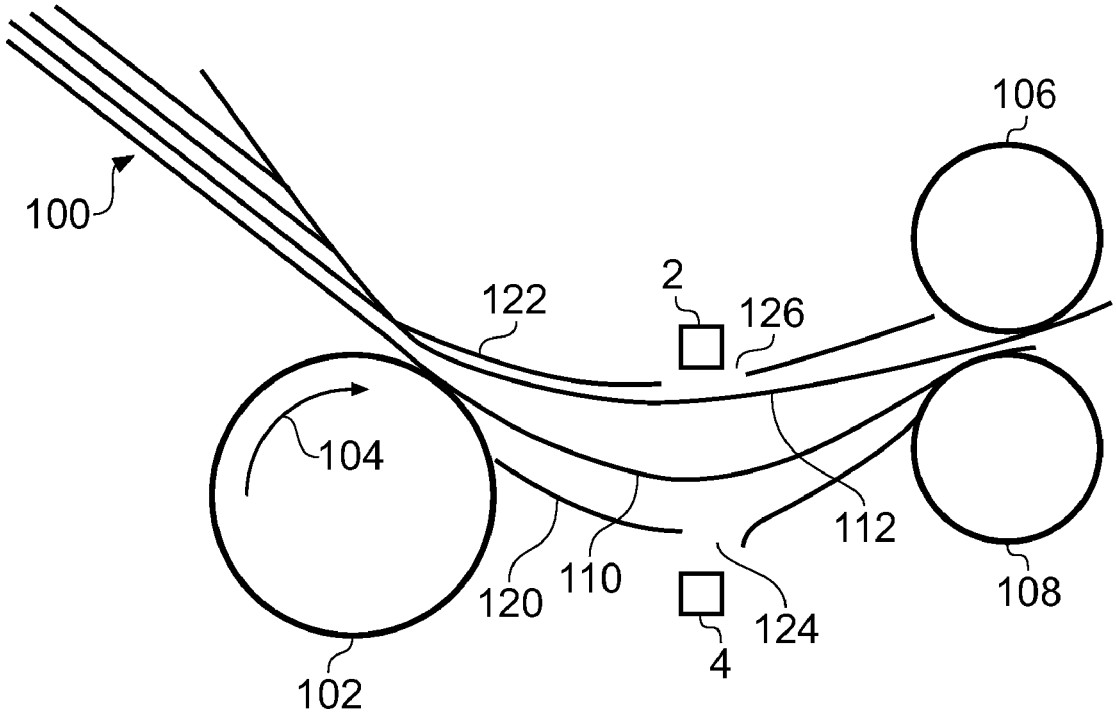
FIG. 5 illustrates a paper transport mechanism adapted to induce a gap to occur between overlapping sheets of paper.

As noted earlier before, and particularly with reference to FIG. 3, the invention works better when an air gap exists between adjacent sheets of paper. Therefore, in order to reliably detect misfeeds it is advantageous for the paper transport path to be arranged so as to introduce an air gap between adjacent sheets of paper if a misfeed occurs. FIG. 5 schematically shows a paper transport mechanism adapted to do this. Generally a paper transport mechanism has a stack of sheets of paper 100 within some paper receptacle. A pickup roller 102 bears against an outermost one of the sheets of paper in the stack 100 and is made of a material such that the co-efficient of friction between the roller and a sheet of paper can be expected to be greater than the co-efficient of friction between a sheet of paper and a neighbouring sheet of paper. Therefore when the pick up roller 102 is rotated in the direction shown by arrow 104 a sheet of paper is removed from the edge of the stack and is directed towards pinch rollers 106 and 108 within the paper transport path. Additional rollers and paper handling devices may exist within the paper handling path, but are omitted for clarity as they do not have any bearing on the present invention. The pinch rollers 106 and 108 rotate together at the same rotational rate and act to more securely grab a sheet of paper between them in order to deliver it to the rest of the paper handling mechanism. In general, the speeds of the roller 102 and those of the rollers 106 and 108 are selected such that the surface speeds of the rollers match one another (the rotational speeds can of course vary because the rollers can have different radii). Alternatively a clutch mechanism can be used with the sheet feeder roll 102 that allows the pinch rollers 106 and 108 to always pull the sheet from the feeder that is running slower than the pinch rollers.

If we suppose, for example, that a paper misfeed occurs such that two sheets of paper are simultaneously picked up by the roller 104, then these two substantially aligned sheets are presented to the rollers 106 and 108. Once this occurs, it becomes apparent that only one of the sheets is in physical contact with the roller 104, whereas the other is not. Therefore, if the roller 104 is temporarily overdriven at an increased rate, a misfed sheet of paper 110 in contact with the roller 104 will be fed towards the pinch rollers 106 and 108 at a rate faster than the other misfed sheet of paper 112 is grabbed by the rollers 106 and 108. As a consequence, the sheet of paper 110 assumes an arcuate path in order to accommodate for the fact that roller 104 is providing it into the region between the roller 104 and the pinch rollers 106 and 108 more quickly than the pinch rollers 106 and 108 are removing it from that region. Therefore a gap opens up between the misfed sheets of paper. The position of that gap can be more clearly controlled if a slightly arcuate paper feed path is introduced between the roller 102 and the pinch rollers 106 and 108. This can be obtained by providing guides 120 and 122. The guides may have aligned apertures 124 and 126 formed therein such that the apertures participate in an optical path between the image source 2 and the image detector 4.

In order to avoid crinkling or distortion of properly fed paper, the duration for which the pick up roller 102 is run at over speed is necessarily limited.

Figure 6:
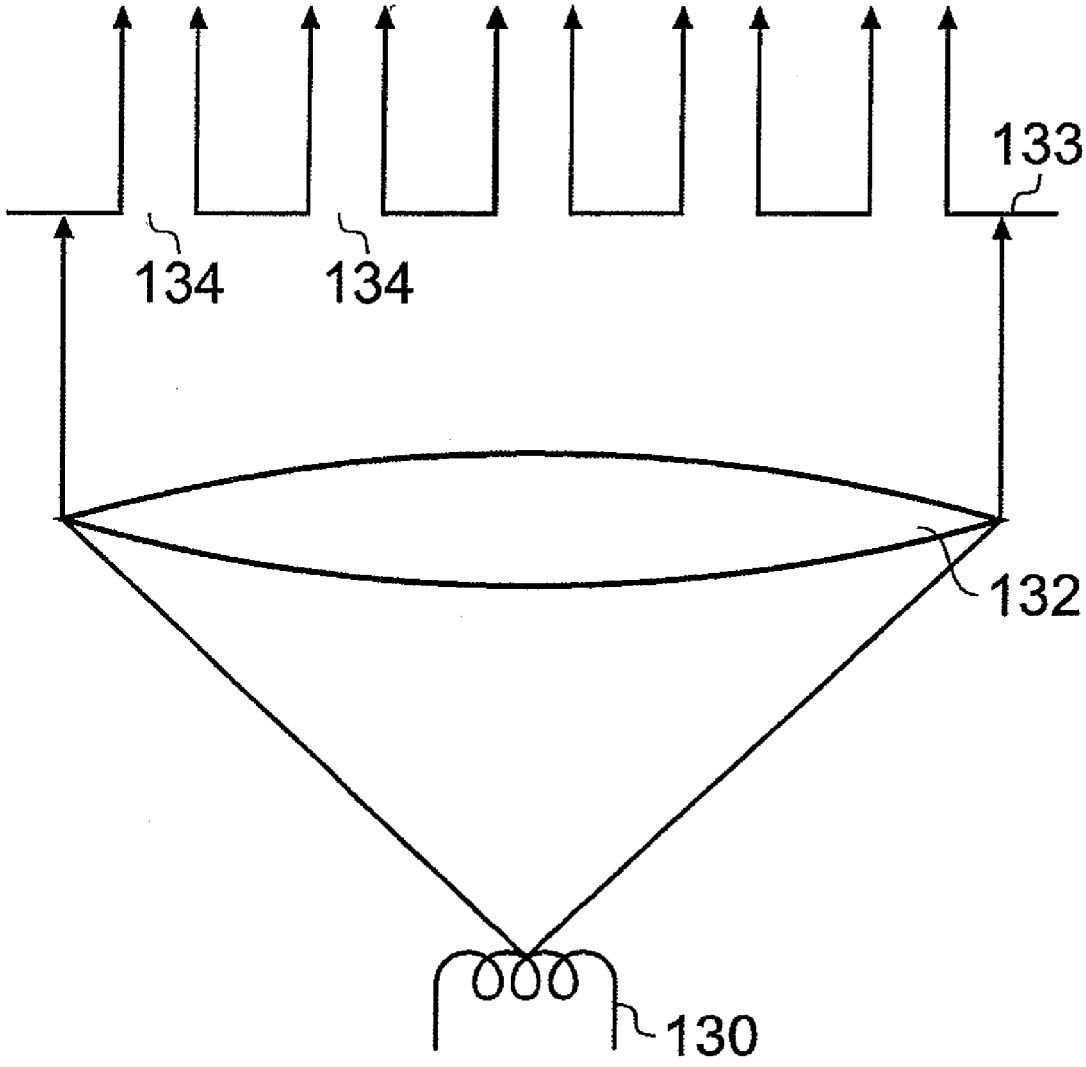
FIG. 6 shows an alternative embodiment of an image source.

The invention can be implemented in other ways. For example, and as shown in FIG. 6, a light source 130 may be positioned substantially at the focal point of a converging lens 132 such that the light exiting the lens is substantially parallel. An image forming device, such as a film of material having an image printed thereon or an element 133 having apertures 134 formed therein may act to define an image source having a spatially varying intensity.

The photodetector array could be replaced by a single photodetector and a scanning arrangement such as a rotating mirror or vibrating optical fibre in order to allow a single photodetector to measure light intensity as a function of position.

It is thus possible to provide an inexpensive and yet reliable optical mechanism for detecting paper misfeeds.

Within the context of a scanner, the paper travelling within the paper transport path is likely to carry data, such as text or images thereon. However, in practice, margins to the left and right, and headers and footers, of a sheet of paper are generally left blank and hence determinations of paper misfeed could be made from portions of a sheet of paper which are expected not to be carrying an image. However, even when a determination of misfeed is made in a portion of a sheet of paper that is carrying data, such as text, the white spaces between lines of text can be identified by the same or a further optical scanner and the data processor arranged to mask off or give less credence to results obtained from portions of paper bearing text or images. In the context of a scanner, given that an image of the paper is obtained during the scanning process and that the speed of the transport rollers is known, it is possible to validate the results of the paper misfeed detector based on knowledge of the image, such as text or pictures, on the paper once the paper has been scanned. Indeed, it is similarly possible to buffer the results of the photodetector array 16 and perform the paper misfeed analysis on buffered data corresponding to a portion of the paper which, as a result of the scanning process, is known not to be carrying text or an image.

It is thus possible to provide an improved system for detecting misfeed of paper.

The invention claimed is:

1. A paper feed detector to detect when a plurality of overlapping sheets of paper occur in a transport path intended to transport paper to a first region, the paper feed detector comprising:

a) a light source and image forming arrangement adapted to form an image having a spatially varying intensity; and b) an image detector;

wherein an optical path from the light source to the image detector passes through the transport path, and the image detector is adapted to assess degradation of the image to make an assessment of the number of sheets within the transport path, and wherein one of:

the light source produces at least one collimated beam of light;

the light source produces an image focused onto a focal plane, the focal plane substantially coinciding with the path of the path.

2. The paper feed detector as claimed in claim 1, wherein the image is formed by at least one of:

i) a plurality of apertures formed in a member;

ii) a freznel lens;

iii) an image bearing element in the optical path; and iv) scanning of a light beam combined with modulation thereof.

3. The paper feed detector as claimed in claim 1, wherein the image produced by the light source comprises alternating lighter and darker regions and wherein the paper feed detector further comprises an image processor adapted to monitor the relative intensities of the lighter and darker regions or the spatial extent of a transition region between lighter and darker intensities.

4. The paper feed detector as claimed in claim 3, wherein the image processor is arranged to form a distribution of image intensities from the photodetector array and to make an assessment of degradation of the image.

5. The paper feed detector as claimed in claim 1, wherein a scanner is used to scan a surface of the paper so as to form an image of the surface and this is used to modify a determination of the number of sheets within the transport path.

6. The paper feed detector as claimed in claim 1, wherein the transport path is intended to transport paper to a first region a single sheet at a time.

7. A paper feed mechanism including a paper feed detector as claimed in claim 1.

8. The paper feed mechanism as claimed in claim 7, having first and second spaced apart driven rollers for conveying paper along a paper transport path and a controller for varying the relative speeds of the rollers so as to promote formation of a gap between overlapping sheets of paper.

9. A photocopier, facsimile machine or scanner including a paper feed mechanism and further including a paper feed detector as claimed in claim 1.

10. A paper feed detector to detect when a plurality of overlapping sheets of paper occur in a transport path intended to transport paper to a first region, the paper feed detector comprising:

a) a light source and image forming arrangement adapted to form an image having a spatially varying intensity; and b) an image detector;

wherein an optical path from the light source to the image detector passes through the transport path, and the image detector is adapted to assess degradation of the image to make an assessment of the number of sheets within the transport path, and wherein the image detector comprises at least one photodetector for receiving the image and a processor responsive to the at least one photodetector.

11. The paper feed detector as claimed in claim 10, wherein at least one photodetector is an array of photodetectors and the processor is responsive to the output of the array to estimate defocusing or blurring of the image at the photodetector array.

12. A paper feed detector to detect when a plurality of overlapping sheets of paper occur in a transport path intended to transport paper to a first region, the paper feed detector comprising:

a) a light source and image forming arrangement adapted to form an image having a spatially varying intensity; and b) an image detector;

wherein an optical path from the light source to the image detector passes through the transport path, and the image detector is adapted to assess degradation of the image to make an assessment of the number of sheets within the transport path, and wherein the image detector is arranged to identify changes in the light passing through the optical path that are indicative of an image being carried by the paper and to modify its assessment of the number of sheets in the transport path.

* * * * *